US010408565B2

(12) United States Patent
Albrecht

(10) Patent No.: US 10,408,565 B2
(45) Date of Patent: Sep. 10, 2019

(54) ACCESSORY MOUNT FOR RIFLE

(71) Applicant: Utah Valley University Foundation, Inc, Orem, UT (US)

(72) Inventor: Ryan Albrecht, Orem, UT (US)

(73) Assignee: UTAH VALLEY UNIVERSITY FOUNDATION, INC., Orem, UT (US)

( * ) Notice: Subject to any disclaimer, the term of this patent is extended or adjusted under 35 U.S.C. 154(b) by 0 days.

(21) Appl. No.: 15/291,957

(22) Filed: Oct. 12, 2016

(65) Prior Publication Data

US 2017/0299327 A1 Oct. 19, 2017

Related U.S. Application Data

(60) Provisional application No. 62/240,387, filed on Oct. 12, 2015.

(51) Int. Cl.
*F41C 27/00* (2006.01)

(52) U.S. Cl.
CPC ..... *F41C 27/00* (2013.01)

(58) Field of Classification Search
CPC .... F41G 11/003; F41G 11/001; F41G 11/002; F41G 11/004; F41G 11/005; F41G 1/38; G03B 17/561; F41C 27/00
USPC ..... 42/124–128; 396/428, 427, 420, 419
See application file for complete search history.

(56) References Cited

U.S. PATENT DOCUMENTS 4,761,888 A * 8/1988 Kudlacek ..... F41G 1/44 33/265
7,178,997 B2 * 2/2007 Claudi ..... G02B 23/16 396/428
8,297,173 B1 * 10/2012 Teetzel ..... F41G 3/165 42/111
8,690,460 B2 * 4/2014 Kuehl ..... G02B 21/36 396/428
8,911,162 B2 * 12/2014 Kuehl ..... G03B 29/00 396/428
8,978,539 B2 * 3/2015 Teetzel ..... F41A 23/08 42/111

(Continued)

OTHER PUBLICATIONS

Author Unknown, "Seben Camera Mount Information", Copyright 2014, SebenCameraMount.com, all pages, <http://sebencameramount.com/>, accessed Feb. 5, 2018. (Year: 2014).*

(Continued)

*Primary Examiner* — Jonathan C Weber
(74) *Attorney, Agent, or Firm* — Kunzler Bean & Adamson

(57) ABSTRACT

In one example, an apparatus for mounting accessories on a rifle includes a base that is mountable to a rifle, an accessory mounting bracket that is L-shaped, the accessory mounting bracket comprising an accessory mounting leg and a depth positioning leg. The depth positioning leg may include a plurality of attachment features disposed along a length thereof that enable attaching the depth positioning leg to the base at a plurality of depth positions. The accessory mounting leg may include a slot for mounting a photographic device at any lateral position within a lateral positioning range (e.g., 3 inches). In some embodiments, the base is mountable to both the left side and the right side of the rifle and the accessory mounting bracket is attachable to the base (on either side of the rifle) at each depth position for any of four orientations.

18 Claims, 4 Drawing Sheets

(56) References Cited

U.S. PATENT DOCUMENTS 9,618,302 B2 * 4/2017 Kintzing ..... F41G 11/003
2005/0036782 A1 * 2/2005 Claudi ..... G02B 23/16 396/428
2006/0156606 A1 * 7/2006 Robinson ..... F41A 15/12 42/7
2011/0099877 A1 * 5/2011 Sandler ..... F41G 11/003 42/90
2012/0240444 A1 * 9/2012 Russell ..... F41C 27/00 42/90
2013/0111798 A2 * 5/2013 Russell ..... F41C 27/00 42/90
2013/0251358 A1 * 9/2013 Kuehl ..... G02B 21/36 396/428
2013/0288743 A1 * 10/2013 Hunt ..... F41G 11/004 455/556.1
2014/0096429 A1 * 4/2014 Sandler ..... F41G 11/003 42/124
2014/0317987 A1 * 10/2014 Kuehl ..... G03B 29/00 42/90
2015/0041538 A1 * 2/2015 Teetzel ..... F41A 23/08 235/404
2016/0377383 A1 * 12/2016 Downing ..... F41G 11/003 42/111

OTHER PUBLICATIONS

Ted's HoldOver user, "Scopecam Setup Using a Seben DKA2 Camera Mount", Published on Sep. 6, 2010, YouTube, Entire Video, <https://www.youtube.com/watch?v=XQ11oVUjbR0>, accessed Feb. 5, 2018. (Year: 2010).*

MrSpiker357, "How to fix the Seben Scopecam DKA2 Camera Mount—Using T.I.G. Weld", Published on Aug. 20, 2013, YouTube, Entire video, <https://www.youtube.com/watch?v=z93d1Kbcris>, accessed Feb. 5, 2018. (Year: 2013).*

* cited by examiner

ACCESSORY MOUNT FOR RIFLE

PRIORITY APPLICATIONS

This application claims the benefit of U.S. provisional application 62/240,387 entitled "Nexus U-Mount" and filed on 12 Oct. 2015. The foregoing application is incorporated herein by reference.

BACKGROUND OF THE INVENTION

The claimed invention relates to systems and devices for mounting accessories on rifles.

Users of rifles often desire to use accessories such as cameras from various perspectives including toward the target, toward the shooter, and to capture video through the rifles optical sight. Additionally the desired placement of such accessories may be dependent on whether the shooter is left-handed or right-handed.

BRIEF SUMMARY OF THE INVENTION

The present invention has been developed in response to the present state of the art, and in particular, in response to the problems and needs in the art that have not yet been fully solved by currently available accessory mounting devices and systems for rifles. Accordingly, the claimed inventions have been developed to overcome shortcomings in the art.

In one example, an apparatus for mounting accessories on a rifle includes a base that is mountable to a rifle, an accessory mounting bracket that is L-shaped, the accessory mounting bracket comprising an accessory mounting leg and a depth positioning leg. The depth positioning leg may include a plurality of attachment features disposed along a length thereof that enable attaching the depth positioning leg to the base at a plurality of depth positions. The accessory mounting leg may include a slot for mounting a photographic device at any lateral position within a lateral positioning range (e.g., 3 inches).

In some embodiments, the base is mountable to both the left side and the right side of the rifle and the accessory mounting bracket is attachable to the base (on either side of the rifle) at each depth position for any of four orientations. The base may comprise a height adjustment member comprising opposed slotted grooves that conform to a top view profile of a guide member of the base. The opposed slotted grooves may enable fastening the height adjustment member to the guide member over a continuous range of heights. The base may include a rifle mount member that is Weaver or mil-spec 1913 compliant.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, specific details are provided to convey a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
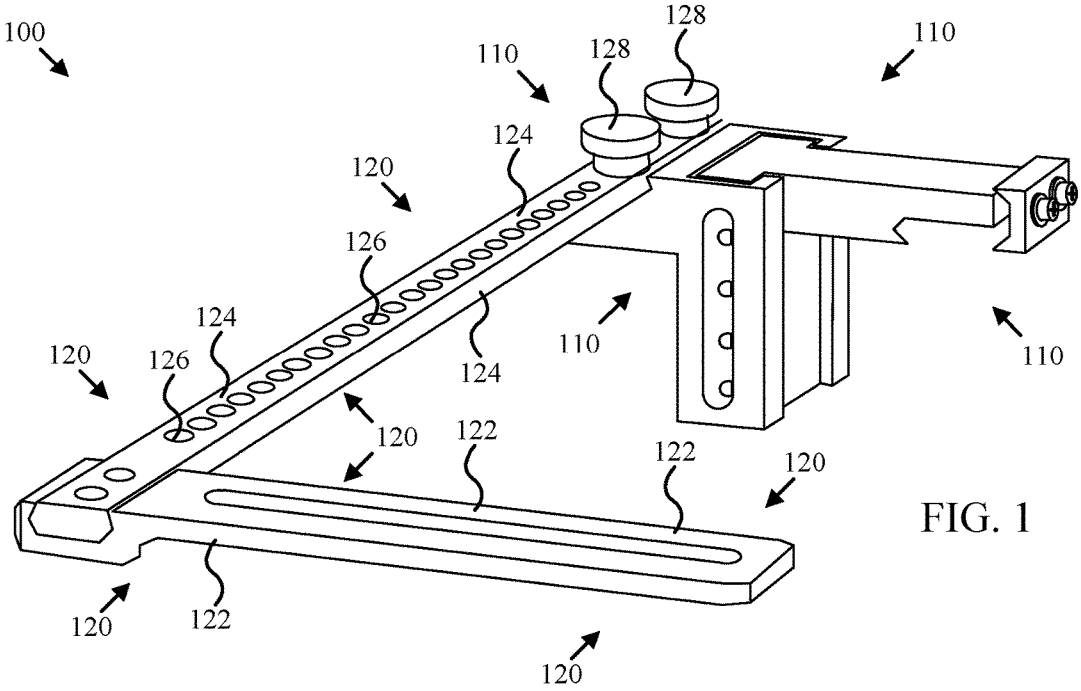
FIG. 1 is a perspective view drawing depicting one example of an assembled accessory mounting apparatus that is consistent with one or more embodiments disclosed herein.

FIG. 1 is a perspective view drawing depicting one example of an assembled accessory mounting apparatus 100 that is consistent with one or more embodiments disclosed herein. As depicted, the accessory mounting apparatus 100 includes a base 110, and an accessory mounting bracket 120 comprising an accessory mounting leg 122 and a depth positioning leg 124. The accessory mounting apparatus enables a user to mount an accessory such as a camera on a rifle.

The depicted base 110 may be mounted on the left side or right side of the rifle. The depicted accessory mounting bracket 120 is L-shaped—where the accessory mounting leg 122 provides the horizontal (lower) leg of the L-shape and the depth positioning leg 124 provides the vertical (upper) leg of the L-shape. The depth positioning leg 124 of the depicted accessory mounting bracket 120 includes a set of attachment features 126 spaced along the length of the leg that enable attaching the depth positioning leg 124 to the base 110 at various depth positions.

In the depicted embodiment, the attachment features 126 are holes or voids through which fasteners 128 such as a bolts or thumbscrews can securely fasten the accessory mounting bracket 120 to the base 110 at a selected depth position. In the depicted embodiment, the selected depth position is determined by which attachment features 126 (e.g., holes or voids) are used to fasten the accessory mounting bracket 120 to the base 110. By using fasteners such as bolts or thumbscrews that pass through the depth positioning leg 124 via the attachment features (holes) 126, the accessory mounting bracket 120 cannot be jarred away from the base 110 due to recoil or other abrupt motions associated with rifles.

Figure 2:
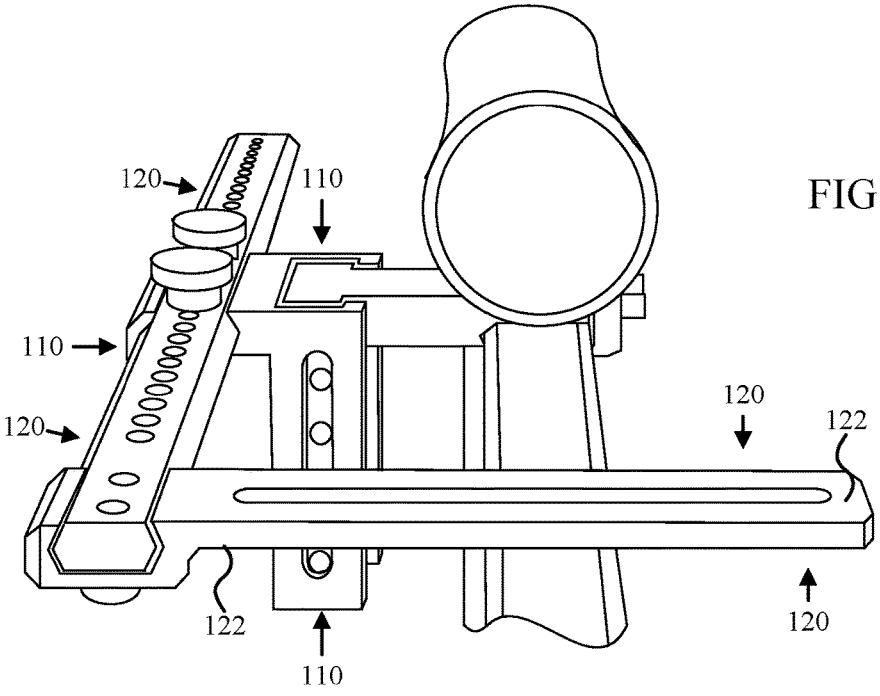
FIG. 2 is a perspective view drawing depicting the accessory mounting apparatus of FIG. 1 mounted on a rifle.

FIG. 2 is a perspective view drawing depicting the accessory mounting apparatus 100 of FIG. 1 mounted on a rifle. In the depicted arrangement, the base 110 is mounted on the left side of the rifle and the accessory mounting bracket 120 is oriented with the accessory mounting leg 122 toward the shooter. In the depicted embodiment, the accessory mounting bracket 120 is secured to the base 110 at a mid-range depth position with the accessory mounting leg 122 protruding over the rifle. However, the accessory mounting bracket 120 may also be flipped about the length of the depth positioning leg 124 so that the accessory mounting leg protrudes away from the rifle. Furthermore, the accessory mounting bracket 120 may also flipped relative to the base and oriented with the accessory mounting leg 122 placed away from the shooter and oriented so that the accessory mounting leg 122 protrudes over, or away from, the rifle.

While shown on the left side, the base 110 may also be mounted on the right side of the rifle and the accessory mounting bracket 120 may be oriented with the accessory mounting leg 122 either toward, or away from, the shooter and projecting over, or away from the rifle. Consequently, in the depicted embodiment four orientations are possible for the accessory mounting bracket on each side of the rifle and a large number of depth positions are possible for each orientation.

Figure 3:
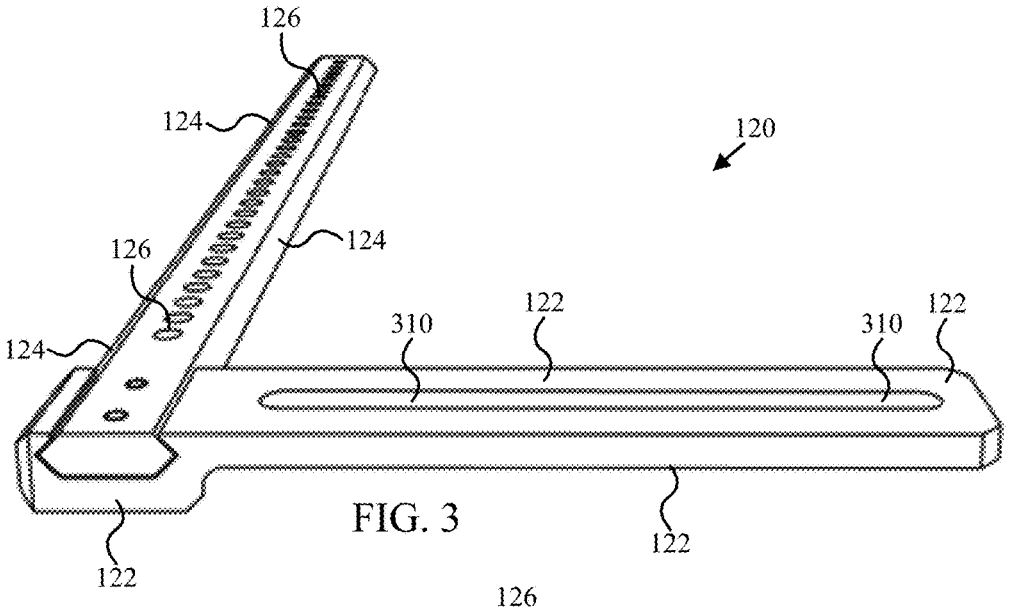
FIG. 3 is a perspective view drawing depicting one example of an accessory mounting bracket that is consistent with one or more embodiments disclosed herein.

FIG. 3 is a perspective view drawing depicting one example of the accessory mounting bracket 120 shown in isolation. As previously described, the accessory mounting bracket 120 includes the accessory mounting leg 122 and the depth positioning leg 124. The depicted accessory mounting leg 122 and the depth positioning leg 124 are separable as shown in FIGS. 4 and 5.

Figure 4:
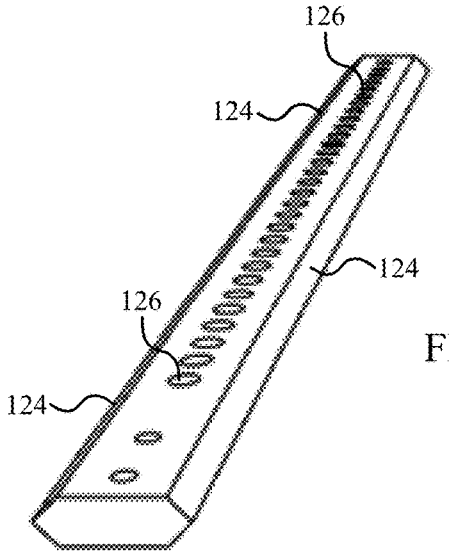
FIG. 4 is a perspective view drawing depicting one example of a depth positioning leg that is consistent with one or more embodiments disclosed herein.
Figure 5:
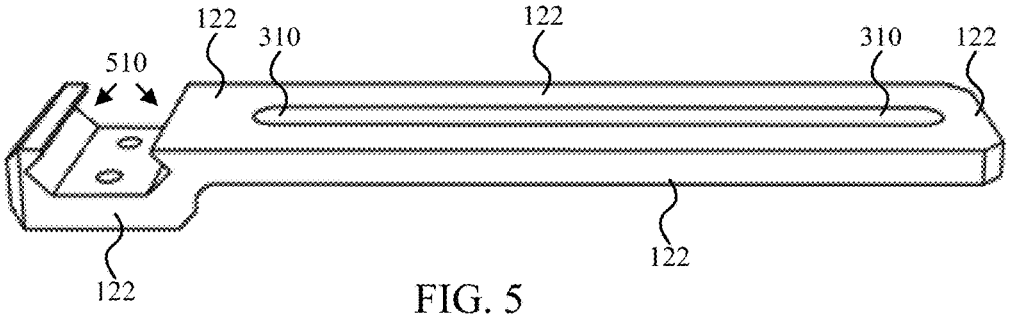
FIG. 5 is a perspective view drawing depicting one example of an accessory mounting leg that is consistent with one or more embodiments disclosed herein.

Referring to FIGS. 3-5, the accessory mounting leg 122 may include a slot 310 for mounting an accessory such as a photographic device at any lateral position within the lateral positioning range of the slot. In the depicted embodiment, the lateral positioning range is at least 3 inches. The slot 310 may be configured to receive a quarter inch tripod adapter screw. Consequently, any camera capable of being mounted on a tripod may be mounted on the accessory mounting leg. As shown in FIG. 5, the accessory mounting leg 122 may include opposed grooves 510 for laterally securement to the depth positioning leg 124. The opposed grooves 510 may conform to a lateral profile of the depth positioning leg. In the depicted embodiment, the opposed grooves 510 are V-grooves. Providing opposed grooves facilitates mating the accessory mount leg 122 to the depth positioning leg 124. Once mated, fasteners such as screws or rivets may be used to rigidly fasten the accessory mount leg 122 to the depth positioning leg 124.

Figure 6:
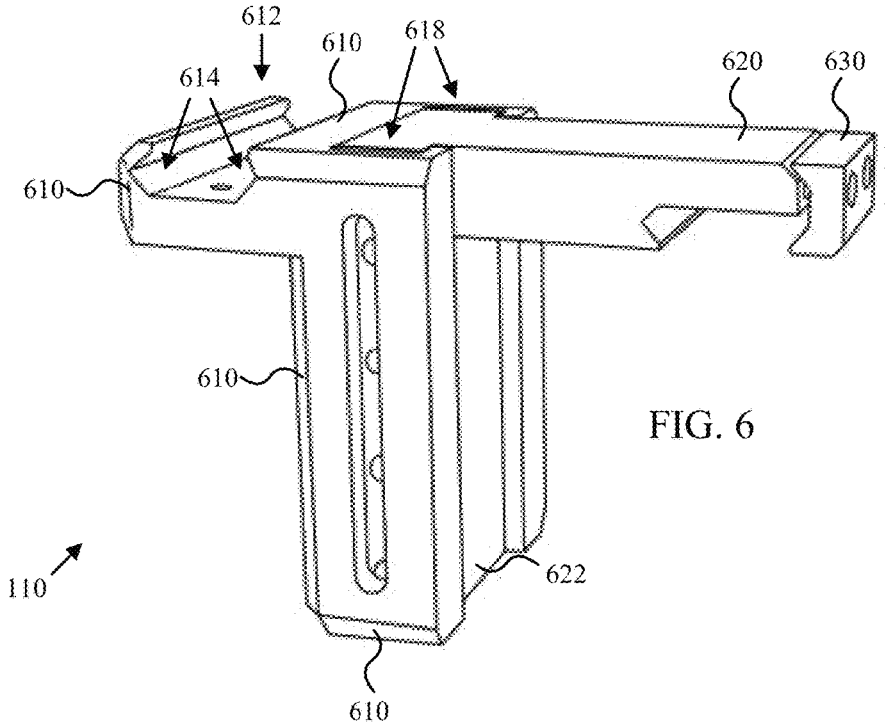
FIG. 6 is a perspective view drawing depicting one example of an assembled rifle mount assembly that is consistent with one or more embodiments disclosed herein.
Figure 7:
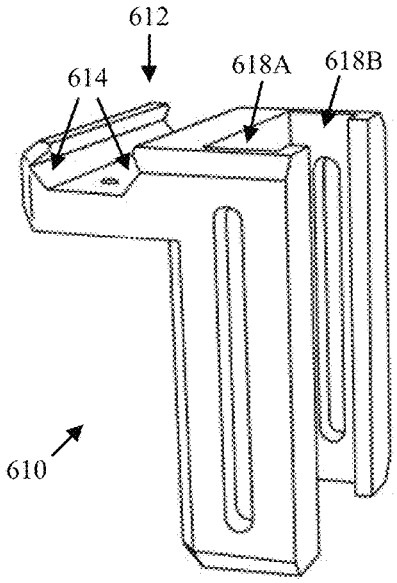
FIG. 7 is a perspective view drawing depicting one example of a height adjustment member that is consistent with one or more embodiments disclosed herein.
Figure 8:
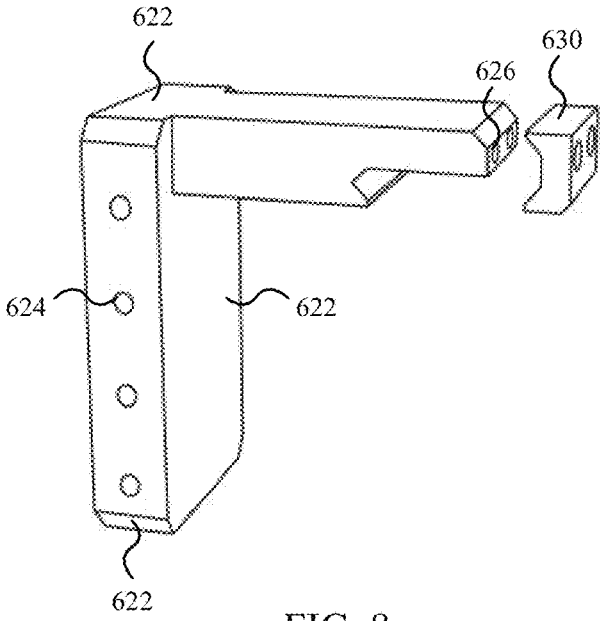
FIG. 8 is a perspective view drawing depicting one example of a rifle mount member and clamp that are consistent with one or more embodiments disclosed herein.

FIG. 6 is a perspective view drawing depicting one example of an assembled rifle mount assembly (i.e., base) 110 that is consistent with one or more embodiments disclosed herein. As depicted, base 110 includes a height adjustment member 610, a rifle mount member 620, and a clamp 630. As shown in FIGS. 7 and 8, the height adjustment member 610 and the rifle mount member 620 may be separable.

Referring to FIGS. 6-8, the height adjustment member 610 may include a positioning leg attachment portion (member) 612. The depicted positioning leg attachment portion 612 includes opposed grooves 614 (i.e., 614A and 614B). The opposed grooves 614 may conform to a lateral profile of the depth positioning leg 124. In the depicted embodiment, the lateral profile of the depth positioning leg 124 is V-shaped and the opposed grooves 614 are V-grooves. The height adjustment member 610 may include threaded holes for fastening the depth positioning leg 124 disposed between the opposed grooves 614 to the height adjustment member 610. Alternately, the depth positioning leg 124 may be riveted to the height adjustment member 610

The rifle mount member 620 may include a lateral arm 621 that extends horizontally from a rifle mounting end of the rifle mounting member and connects to a vertical arm (or guide member 622) that extends downward from the lateral arm 621. The vertical arm 622 may be slidably connected to the height adjustment member 610 and thereby enable the height adjustment member 610 to be vertically moved relative to the rifle mounting member 620. The height adjustment member 610 may also include, or be connected to, an open channel 618 that comprises opposed slotted grooves 618A and 618B. The open channel 618 partially encompasses the vertical arm 622 and thereby enables an accessory mounting bracket attached to the height adjustment member 610 to be vertically moved relative to the rifle mounting member 620, including above and below the lateral arm, without the lateral arm of the rifle mounting member blocking vertical movement of the height adjustment member. In the depicted embodiment, the opposed slotted grooves 618A and 618B conform to a top view profile of the guide member (or vertical arm) 622. The guide member 622 may be a portion of, or connected to, the rifle mount member 620. The depicted opposed slotted grooves 618A and 618B enable fastening the height adjustment member 610 to the guide member 622 over a continuous range of heights and sliding the height adjustment member 610 to adjust the height of the accessory mounting bracket 120 (not shown) relative to the rifle. The guide member 622 may include threaded holes 624 for fastening the height adjustment member 610 to the guide member (e.g., via one or more bolts).

The rifle mount member 620 may be Weaver or mil-spec 1913 compliant. In the depicted embodiment, the rifle mount member 620 includes threaded holes 626 that enable clamping the rifle mount member 620 to a rifle by tightening the clamp 630 via fasteners such as bolts or screws (not shown).

Figure 9:
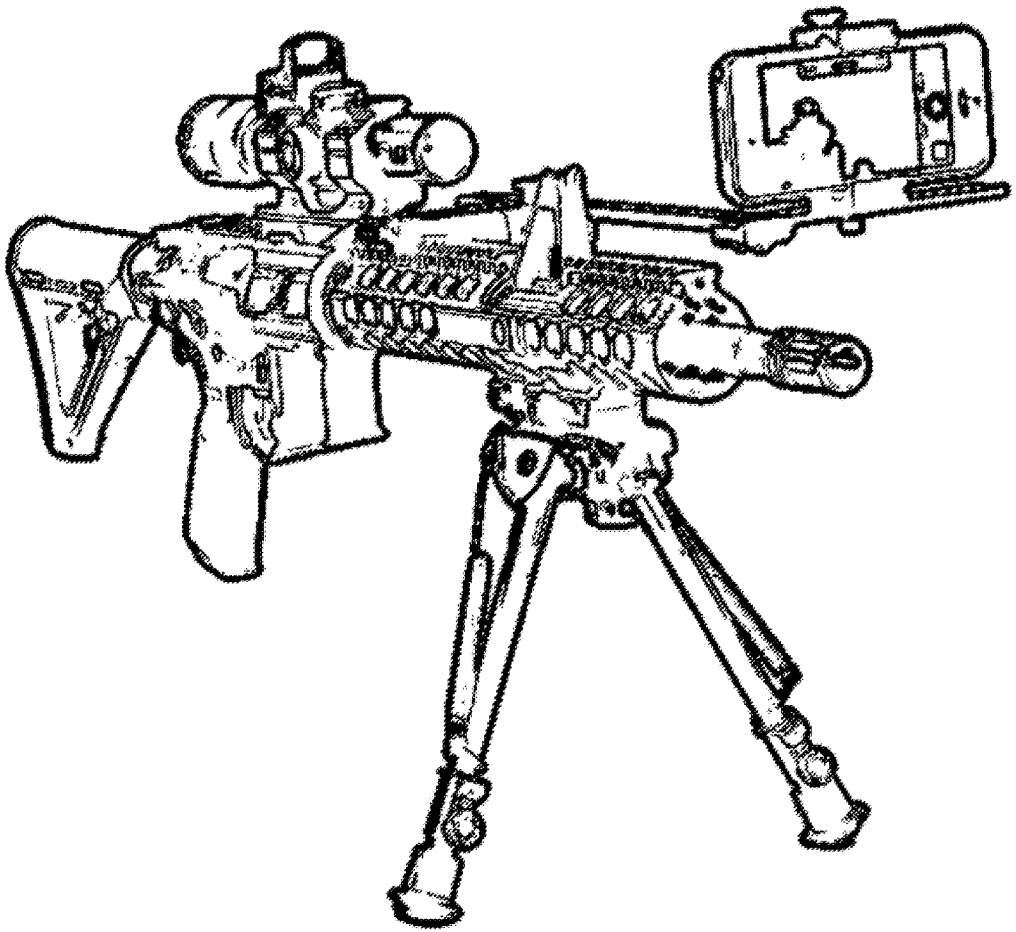
FIG. 9 is a perspective view drawing depicting a rifle with the accessory mounting apparatus of FIG. 1 mounted thereon and a cell phone mounted on the rifle accessory mounting apparatus.

FIG. 9 is a perspective view drawing depicting a rifle with the accessory mounting apparatus of FIG. 1 mounted thereon and a cell phone mounted on the rifle accessory mounting apparatus. In the depicted arrangement, the accessory mounting apparatus is mounted on the left side of the rifle (from the shooters perspective) with the accessory mounting leg placed away from the shooter and projecting away from the rifle. Consequently, the mounted cell phone may be used to take pictures or videos of a (right-handed) shooter.

What is claimed is:

1. An apparatus for mounting accessories on a rifle, the apparatus comprising:

a base comprising a height adjustment member and a rifle mounting member, wherein the rifle mounting member is directly mountable to a mounting rail of a rifle, the mounting rail effectively providing a planar mating surface that extends along a the length of the mounting rail and parallel to a depth axis of the rifle;

an accessory mounting bracket, that is L-shaped, oriented parallel to the planar mating surface of the mounting rail and attached to the height adjustment member, the accessory mounting bracket comprising an accessory mounting leg and a depth positioning leg;

wherein the depth positioning leg comprises at least six attachment features disposed along a length thereof that enable attaching the depth positioning leg to the base at a plurality of depth positions;

wherein the rifle mounting member comprises a lateral arm that extends horizontally from a rifle mounting end of the rifle mounting member perpendicular to the depth axis of the rifle and parallel to the planar mating surface of the mounting rail and connects to a vertical arm that extends downward from the lateral arm and perpendicular to the planar mating surface of the mounting rail; and wherein the height adjustment member comprises an open channel that partially encompasses the vertical arm and thereby enables the accessory mounting bracket to be vertically moved relative to the lateral arm, including above and below the lateral arm, without the lateral arm of the rifle mounting member blocking vertical movement of the height adjustment member.

2. The apparatus of claim 1, wherein the accessory mounting leg comprises a slot for mounting a photographic device at any lateral position within a lateral positioning range.

3. The apparatus of claim 1, wherein the accessory mounting bracket is attachable to the base at each depth position for any of four orientations.

4. The apparatus of claim 1, wherein the accessory mounting bracket is attachable to the base via one or more fasteners.

5. The apparatus of claim 1, wherein the height adjustment member comprises opposed slotted grooves that conform to a top view profile of the vertical arm.

6. The apparatus of claim 5, wherein the opposed slotted grooves enable fastening the height adjustment member to the vertical arm over a continuous range of heights.

7. The apparatus of claim 5, wherein the vertical arm comprises at least one threaded hole for fastening the height adjustment member to the guide member.

8. The apparatus of claim 1, wherein the height adjustment member comprises threaded holes for fastening the depth positioning leg to the height adjustment member.

9. The apparatus of claim 1, wherein the rifle mount member is Weaver or mil-spec 1913 compliant.

10. The apparatus of claim 1, wherein the accessory mounting leg and the depth positioning leg are separable.

11. The apparatus of claim 1, wherein the accessory mounting leg comprises first opposed grooves for laterally securement to the depth positioning leg.

12. The apparatus of claim 11, wherein the first opposed grooves conform to a lateral profile of the depth positioning leg.

13. The apparatus of claim 12, wherein the lateral profile is V-shaped and the first opposed grooves comprise V-grooves.

14. The apparatus of claim 1, wherein the base comprises a positioning leg attachment portion.

15. The apparatus of claim 14, wherein the positioning leg attachment portion comprises second opposed grooves.

16. The apparatus of claim 15, wherein the second opposed grooves conform to a lateral profile of the depth positioning leg.

17. The apparatus of claim 16, wherein the lateral profile is V-shaped and the second opposed grooves comprise V-grooves.

18. The apparatus of claim 1, wherein each of the plurality of attachment features is a hole.

* * * * *